United States Patent [19]

McCormack

[11] 4,067,380

[45] Jan. 10, 1978

[54] MAKING FOUNDRY MOULDS

[75] Inventor: William McCormack, Studley, England

[73] Assignee: British Cast Iron Research Association, Birmingham, England

[21] Appl. No.: 682,846

[22] Filed: May 4, 1976

Related U.S. Application Data

[62] Division of Ser. No. 483,767, June 27, 1974, Pat. No. 3,989,087.

[30] Foreign Application Priority Data

June 28, 1973 United Kingdom ..... 30943/73

[51] Int. Cl.[2] ..... B22C 13/08; B22C 15/08

[52] U.S. Cl. ..... 164/166; 164/171

[58] Field of Search ..... 164/37, 170, 171, 160, 164/166

[56] References Cited

U.S. PATENT DOCUMENTS

| | | | |
|---|---|---|---|
| 2,805,455 | 9/1957 | Whitesell | 164/170 |
| 2,852,820 | 9/1958 | Taccone | 164/170 |
| 2,882,566 | 4/1959 | Redhead | 164/170 |
| 2,956,317 | 10/1960 | Peasley | 164/170 |
| 3,538,979 | 11/1970 | Medill | 164/170 |
| 3,952,793 | 4/1976 | Hijikata | 164/170 X |

*Primary Examiner*—Robert D. Baldwin
*Assistant Examiner*—John S. Brown
*Attorney, Agent, or Firm*—Scrivener, Parker, Scrivener & Clarke

[57] ABSTRACT

In a method of forming foundry sand moulds employing a cold-setting sand mixture pressed around a pattern by the use of pneumatic pressure acting on a flexible diaphragm, the sand is formed into a horizontal layer of approximately uniform thickness in a frame of which the bottom wall is formed by the diaphragm, the pattern is then pressed into that layer of sand, causing the diaphragm to bulge downwards, then the gas pressure (conveniently air pressure) is applied to compact the sand, which thereupon sets to allow separation of the resultant mould body from the diaphragm and pattern. During the initial formation of the layer the diaphragm can be supported by a further, stronger diaphragm, which is perforated to allow the gas pressure through, or by a rigid pad, or both.

4 Claims, 11 Drawing Figures

MAKING FOUNDRY MOULDS

Figure 1:
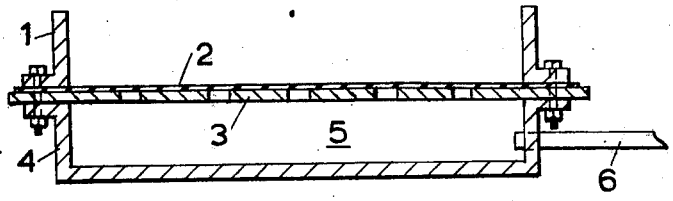

This is a division of application Ser. No. 483,767, filed June 27, 1974 now U.S. Pat. No. 3,989,087.

This invention relates to the making of foundry moulds. Where such moulds are made in flasks or boxes by the usual greensand process, or even employing a cold-setting resin, the amount of sand used is generally that needed to fill the box, no matter what the size and shape of the pattern being used. This is wasteful of sand and, if a reclamation process is to be applied, more sand than necessary has to be handled and treated, making the cost higher than it need be.

Ideally, it would be sufficient to have layer of sand of adequate uniform thickness around the pattern. This is achieved by the shell-moulding process, and in the hot box process, in which the resulting thin-walled bodies of sand are either backed with another inert material, such as shot, or are strong enough to be used without boxes at all. However these processes are expensive and involve the application of the heat required for curing.

In the ordinary greensand process it has been proposed to press the body of sand down onto the pattern plate by the use of a contoured squeeze plate, the underside of which has a shape which is complementary to that of the pattern. A separate shape of squeeze plate is required to match each pattern. Alternatively, it has been proposed to use a flexible rubber diaphragm, acted on by pneumatic or hydraulic pressure, to press the sand down onto the pattern plate. However, this method results in uneven compaction of the sand as the sand is squeezed more in the regions where the pattern is deep than over the shallower parts of the pattern and in the regions laterally clear of the pattern. Moreover it does not achieve any significant economy in sand.

The aim of the invention is to allow the formation of a relatively thin layer of sand over the pattern, largely regardless of the shape of the pattern, yet to achieve reasonably uniform compaction over the extent of this layer, and without having to resort to shell-moulding, hot-box or other heat-curing methods.

According to the invention this is achieved by forming a horizontally extending layer of granular refractory material of substantially uniform thickness in an open-topped frame having a bottom wall in the form of a flexible and extensible diaphragm, forcing a pattern into the layer of sand from above and, in doing so, stretching the bottom wall, sealing the pattern to the frame, forming or providing a plenum chamber on the opposite side of the diaphragm from the refractory material, applying gas pressure to the plenum chamber to cause the diaphragm to compact the refractory material against and around the pattern, setting the refractory material to form a solid body, and then separating the resultant body from the pattern and the diaphragm.

In the known process that used a contoured squeeze plate or a rubber diaphragm, the body of sand was of varying effective depth before squeezing, being for example thinner over the high parts of the pattern than elsewhere. In contrast to this, in our method now proposed, we start off with a body of sand that is of substantially uniform depth all over. When the pattern plate is pushed down into its upper face it is distorted, in that the parts below the high parts of the pattern are pushed downwards further than elsewhere, and are also probably compressed to a greater degree initially, but when the force is applied to the flexible wall the whole body is squeezed uniformly and to an approximately uniform depth, regardless of the shape of the pattern.

It will be appreciated that the invention is primarily of value where the pattern is of substantial depth. It may well even be greater than the depth of the box. In fact the box can be much shallower than ordinary moulding boxes or flasks.

According to a further feature of the invention the flexible diaphragm may be supported by an additional flexible and extensible member of greater strength than the diaphragm but permeable to the gas pressure. This additional member can itself be a perforated diaphragm, or a net or a grid of webbing.

Instead of, or in addition to this additional member, the diaphragm may be supported by a rigid member during the formation of the layer of granular material, this member subsequently being separated from the diaphragm to allow the pattern to be forced into the layer.

Figure 2:
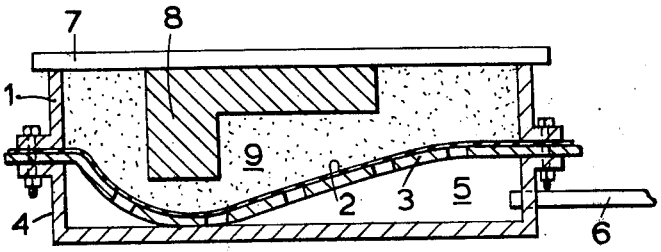
Figure 3:
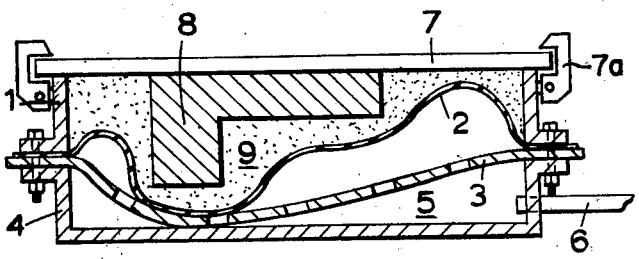
Figure 4:
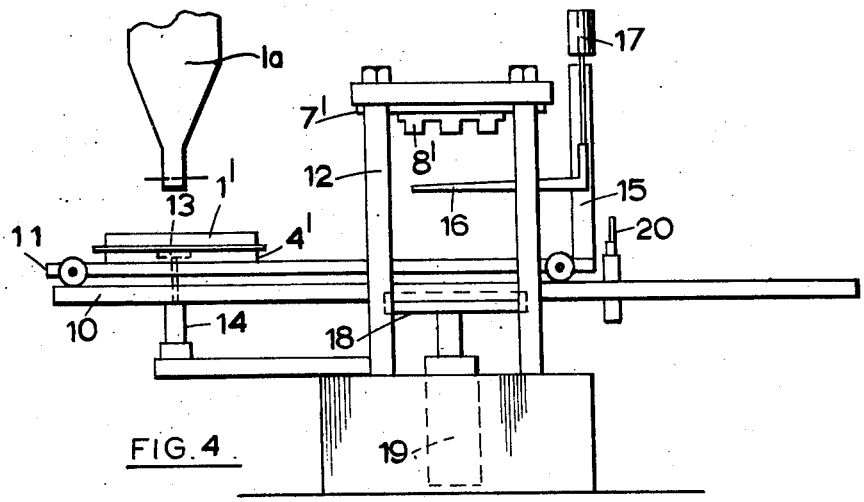

The invention will now be further described by way of example with reference to the accompanying drawings, in which:

FIGS. 1, 2 and 3 serve to illustrate the principle of the invention and show successive stages in the formation of a mould;

FIG. 4 is a perspective view of a practical machine for producing moulds automatically in accordance with the invention; and FIGS. 5 to 11 show diagrammatically successive stages in the cycle of the machine illustrated in FIG. 4.

Referring first to FIGS. 1, 2 and 3, a shallow open frame 1, conveniently rectangular, has its lower face closed by a thin flexible rubber diaphragm 2 which is itself supported by a thicker diaphragm 3, which may also be of rubber but which is perforated, and which may be replaced by a net or a grid of strong but stretchable webbing. Clamped to the frame below this is a closed box-like structure 4 forming, with the thin diaphragm 2, an air-tight plenum chamber 5 with a connection 6 to a source of compressed air.

To form a mould the frame 1 is filled with a normal refractory foundry moulding mixture, which we will refer to simply as sand, although it will in fact contain the usual additives for hardening, such as a resin or sodium silicate. The weight of the sand will only cause the diaphragm 2 to sag very slightly, because of the support provided by the stronger diaphragm 3 below it. The surface of the body of sand in the frame 1 is strickled off level with the upper edge of the box, and so we have produced a flat horizontally extending layer of sand of substantially uniform thickness, perhaps slightly thicker in the centre than the edges owing to the slight sag of the diaphragm 2.

A pattern plate 7 (see FIG. 2), carrying a pattern 8 is placed face downwards in the frame 1, so that the pattern 8 is pressed into the sand (shown at 9) and causes both diaphragms to bulge downwards to a considerable extent. At this stage the plenum chamber 5 is at atmospheric pressure. It will be seen that the depth of the pattern may well, as in the example shown, be greater than the depth of the frame 1. It will also be seen that the pattern plate 7 extends horizontally beyond the frame 1 and so the co-operation of the pattern plate with the frame forms stop means limiting the downward movement of the pattern plate to a point where its lower surface substantially coincides with the upper edge of the frame.

The pattern plate 7 is clamped in place in any convenient manner such as by the clamps 7*a* shown. A gas under pressure, conveniently compressed air, is then admitted to the plenum chamber 5. It passes through the perforated thick diaphragm or net 3 and raises the thin diaphragm 2, squeezing the sand 9 tightly against and around the pattern 8 as shown in FIG. 3. The important point to observe is that we started with a layer of sand of substantially uniform thickness and so in squeezing this sand against the pattern we obtain a body which is at least of fairly constant thickness over the high points as well as the low points of the pattern. Consequently the degree of compaction of the sand is correspondingly constant over the whole projected area of the pattern. Moreover, it will be seen that the layer of sand, even before compaction, was smaller in thickness than the maximum height of the pattern, and so a considerable economy in sand is achieved. The thickness of the layer of sand, governed by the depth of the frame 1, is selected simply to give the finished mould component, which we term a 'biscuit' adequate strength, taking into account the binder which is used.

Where the binder is a resin binder the air pressure in the chamber 5 will be maintained long enough for it to set to a degree sufficient to allow the biscuits to be remove and handled. Where sodium silicate is used the sand can be gassed by carbon dioxide through holes in the pattern plate 7 and/or the frame 1, while air pressure is maintained in the chamber 5.

The new method of forming moulds in accordance with the invention thus allows mould biscuits to be produced with a minimum quantity of sand yet a reasonably uniform compaction of the sand despite varying pattern shapes, and without the complications of heating or of using specially spaced squeeze plates individual to each pattern.

The use of the perforated diaphragm 4 or any equivalent stretchable net or webbing, allows the main diaphragm to be made thin enough and stretchable enough to follow closely the contours of the pattern and thereby ensure even compaction all round it, without the diaphragm sagging so far during the initial formation of the layer of sand to result in a layer of seriously nonuniform thickness, which would defeat the object of the invention.

It is essential that the pattern be pushed into the body of sand from above. However, once this is done and after the pattern plate has been clamped to the frame 1, the whole assembly could be inverted if desired, either before or after the application of the air pressure.

In the practical semi-automatic machine illustrated in FIG. 4 the frame carrying the two diaphragms and an open lower structure is filled with sand at one station and then displaced laterally to a station where the lower structure comes into sealing engagement with a vertically movable table to form the plenum chamber while simultaneously the table lifts the entire frame assembly upwards into engagement with a fixed pattern plate. Air pressure is applied and a biscuit is formed. The table then retracts, lowering the frame assembly and leaving a biscuit adhering to the pattern. The pattern is vibrated to free the biscuit, which is carried away laterally by a pair of arms to a third station, from which it can be transferred to a conveyor or otherwise further handled.

The machine of FIG. 4 comprises a pair of rails 10 carrying a horizontally moving trolley 11 which passes through a portal frame 12 carrying a pattern plate 7′ with a downwardly facing pattern 8′. A frame 1′ occupies approximately one half of the trolley 11 and has the two diaphragms, one thin and continuous, the other stronger but perforated, but these diaphragms are not visible in FIG. 4. The diaphragm are clamped to the underside of the frame 1′ by a further frame structure 4′ of which the lower face is open, unlike the structure 4 of FIGS. 1, 2 and 3, and is surrounded by an O-ring, not visible.

The fixed structure of the machine carries a diaphragm-supporting pad 13 mounted on the upper end of a vertical pneumatic ram 14 and, when the trolley 11 is at the lefthand end of its travel (as viewed in FIG. 4), this pad 13 is in the centre of the opening in the structure 4′.

The other end of the trolley 11, i.e. that furthest from the frame 1′, carries a mast 15 supporting a pair of horizontally protruding forks 16, movable vertically under the action of a pneumatic ram 17. When the trolley is in its left-hand end position, shown in FIG. 4, these forks protrude into the space within the portal frame 12.

A table 18 within the portal frame 12 is movable vertically under the action of a pneumatic ram 19. There is a vibrator which acts on the pattern plate but is not shown in FIG. 4 in the interests of clarity. Finally there is a retractable stop 20, actuated pneumatically the purpose of which will become apparent later. Various safety interlocks, trips and limit switches have not been illustrated in FIG. 4 as their purposes and operation will be well understood by those skilled in the art. For example a swinging flap in the path of the frame 1′ can control a micro-switch to halt the cycle if the frame passes to the squeezing and pressurising station without a change of sand.

The cycle of the machine shown in FIG. 4 will now be briefly described with reference to FIGS. 5 to 11. We start (see FIG. 5) with the trolley 11 at its left-hand position, the table 18 lowered, and the stop 20 lowered. A previously made biscuit 21 is resting on the forks 16. The diaphragm supporting pad 13 is raised, its position being adjustable to suit frames 1′ of different depths.

Figure 7:
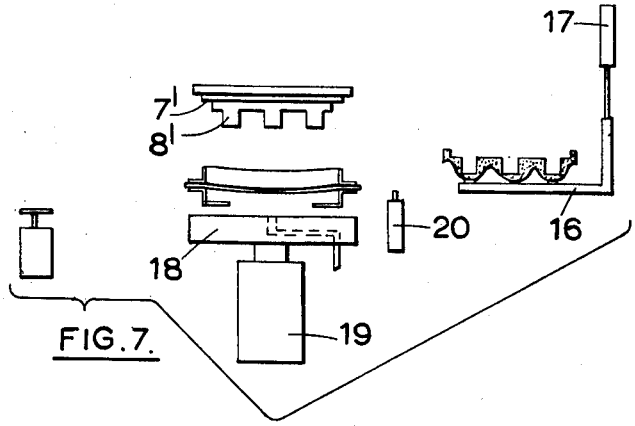

To start the cycle sand is fed to the frame 1′ for example by means of a normal sand slinger or chute 1a, and it is strickled off level with the top of the frame 1′, by hand or by a powered strickle board (not shown). The pad 13 prevents the diaphragms sagging during filling. The pad $1^3$ is then retracted (FIG. 6) and the trolley 11 moves to its right-hand end position (FIG. 7). This carries the frame assembly 1′, 4′ to a position between the table 18 and the pattern plate 7′, and at the same time carries the previously made biscuit 21 clear of the frame 12.

Figure 8:
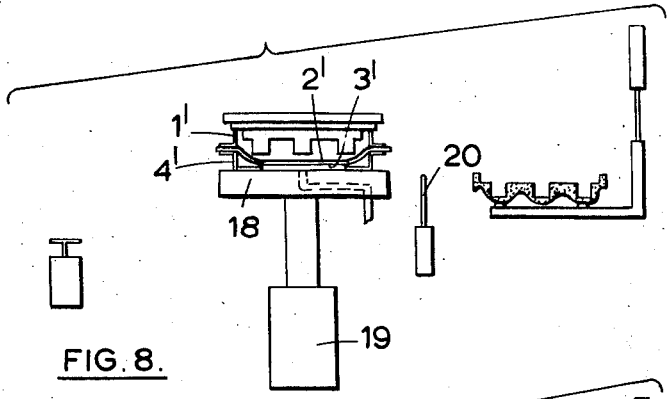

The ram 19 is now energised to raise the table 18, which lifts the frame assembly 1′, 4′ clear of the trolley 11, and into engagement with the pattern plate 7′. This causes the pattern 8′ to be pressed into the sand. At the same time an airtight seal is formed between the table 18 and the O-ring (mentioned earlier) on the frame structure 4′. FIG. 8 shows this condition, with the frame assembly in section to show the line of the diaphragms at 2′ and 3′. Also it will be seen that the stop 20 is now raised.

Figure 9:
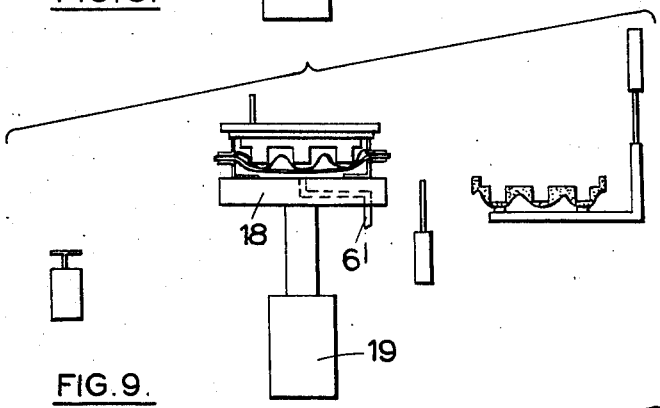
Figure 10:
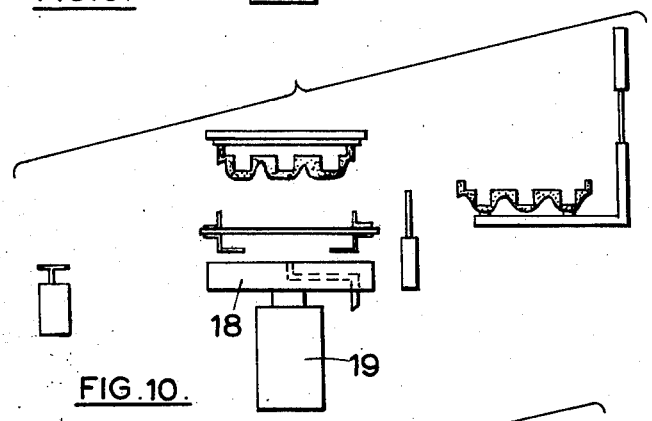
Figure 11:
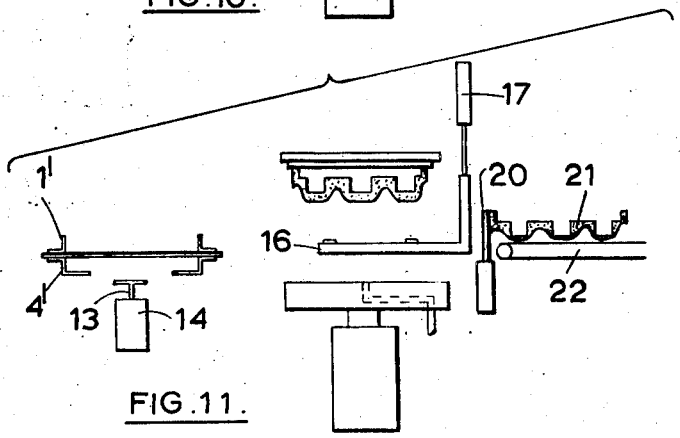

Air pressure is now applied through a connection 6′ to the table 18 and thence to the underside of the diaphragm 2′, compacting the sand around the pattern 8′ (see FIG. 9). At the same time the pattern may be vibrated to ensure that the sand follows intricate contours in the pattern.

Where the sand contains sodium silicate as a hardener, carbon dioxide gas is now passed through it, entering through passages (not shown) in the pattern 8' and escaping through vents in the frame 1. If a self-setting hardener is used there is a delay to allow hardening to take place.

Next the table 18 is lowered (FIG. 10) and limited air pressure is simultaneously applied to the diaphragm 2' so that the frame assembly drops back onto the trolley 11 leaving the newly made biscuit of sand clinging to the pattern 8'.

The trolley 11 is now moved back to its left-hand position, carrying the frame assembly 1', 4' back to its starting point and bringing the forks 16 back under the pattern plate 7'. The stop 20 has meanwhile acted to hold back the previously formed biscuit 21, which is therefore now clear of the forks and is either removed by hand or drops onto a conveyor, shown at 22 in FIG. 11.

Figure 5:
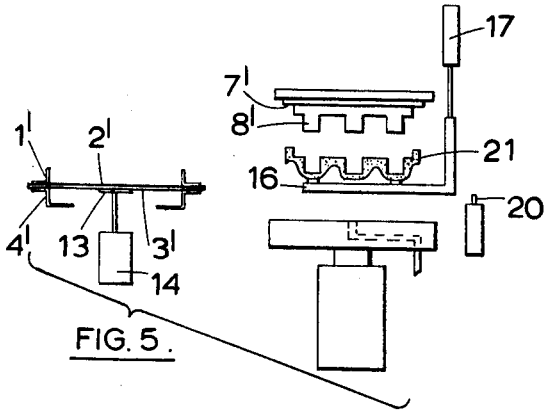
Figure 6:
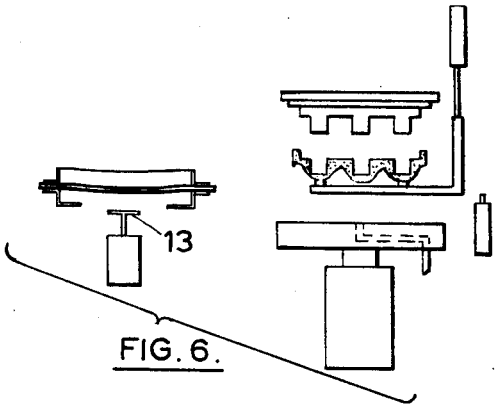

Meanwhile the forks 16 are raised, by means of the ram 17, to engage the newly formed biscuit and the vibrator (not shown) is actuated to loosen the biscuit so that when the forks are now lowered again, the biscuit rests on them, as shown in FIG. 5. In addition to being vibrated, the biscuit can be further assisted to leave the pattern 8' by applying air pressure through the gassing passages in the pattern.

Finally the pad 13 is raised again to its predetermined position, level with the horizontal plane of the diaphragm 2' and 3', and the machine is ready to repeat the cycle.

In a typical example one mould biscuit up to 38cm by 43cm in width and length is produced every forty-five seconds. It will be appreciated that the sequence described lends itself to completely automatic operation.

The provision of the rigid supporting pad 13 may make it possible to omit the second diaphragm 3'. The important thing is that the pad, and/or the diaphragm 3', supports the thin diaphragm 2' during filling and so ensures that the layer of sand is of approximately uniform thickness, and it does not matter if the layer sags later, even before the pattern is pressed into it, provided it does not sag far enough to allow the sand to slide laterally.

I claim:

1. Apparatus for forming foundry refractory mold components comprising an open-topped frame, a bottom wall on said frame in the form of a flexible and extensible first diaphragm impermeable to gas pressure, a flexible and extensible second diaphragm forming a support layer immediately below said first diaphragm and serving to support said first diaphragm in a substantially flat horizontal state during filling of said frame to the top edge thereof with a layer of granular refractory material whereby said layer of refractory material is of substantially uniform thickness, said second diaphragm being of greater stiffness than said first diaphragm but being permeable to gas pressure, means defining a plenum chamber below said second diaphragm, a pattern plate carrying a downwardly facing pattern, means clamping said pattern plate carrying said downwardly facing pattern to the open top of said frame to close the same with said pattern held fixedly in said refractory material, and means communicating with said plenum chamber for applying gas pressure to said plenum chamber.

2. Apparatus for forming foundry refractory mold components comprising an open-topped frame, a bottom wall on said frame in the form of a flexible and extensible gas-impermeable diaphragm, means at a first position above said frame for filling a layer of granular refractory material into said frame level with the top edge thereof, and means at said first position below said diaphragm for supporting said diaphragm in a substantially flat horizontal state while this is done whereby said layer is of substantially uniform thickness, means extending from said first position to a second position for transferring said frame to said second position, means cooperating with said diaphragm and defining a gas-tight plenum chamber below said diaphragm, a stationary pattern plate disposed above said frame, at said second position, said pattern plate carrying a downwardly facing pattern, a vertically movable table at said second position and aligned vertically below said pattern plate, said table being adapted, on vertical upward movement, to lift said frame into engagement with said pattern plate whereby said pattern is caused to enter said layer of refractory material, and means communicating with said plenum chamber for applying gas pressure to said plenum chamber.

3. The apparatus set forth in claim 2, wherein said means defining a plenum chamber comprise said table co-operating with a portion of said frame.

4. Apparatus for forming foundry refractory mold components comprising an open-topped frame, a bottom wall on said frame in the form of a flexible and extensible gas-impermeable diaphragm, means at a first position above said frame for filling a layer of granular refractory material into said frame level with the top edge thereof, a rigid support pad disposed below said diaphragm at said first position, means connected to said pad for raising said pad vertically to a position supporting said diaphragm in a substantially flat horizontal state during said filling, whereby said layer of refractory material is of substantially uniform thickness, and thereafter lowering said pad to a position where it is entirely separated from said diaphragm, means extending from said first position to a second position for transferring said frame to said second position, a horizontal pattern plate at said second position, a pattern depending from said pattern plate, means at said second position, for bringing said open-topped frame, filled with said uniform layer of granular material but without rigid support of said diaphragm, and the underside of said pattern plate into engagement with each other whereby said pattern is forced into said layer, said horizontal pattern plate co-operating with said open-topped frame to create a stop means, said stop means limiting said engagement to a point where the lower surface of said pattern plate substantially coincides with the upper edge of said frame, means cooperating with said diaphragm and defining a gas-tight plenum chamber below said diaphragm, and means communicating with said plenum chamber for applying gas pressure to said plenum chamber to force the same upwardly and compact the granular material about said pattern.

* * * * *